US006980117B1

(12) United States Patent
Kirkland et al.

(10) Patent No.: US 6,980,117 B1
(45) Date of Patent: Dec. 27, 2005

(54) METHOD AND SYSTEM FOR REMOTELY MONITORING GARAGE DOOR POSITION

(75) Inventors: Ronnie L. Kirkland, 8946 Arcade Ave., Jacksonville, FL (US) 32216; Benjamin M. Rubin, Jacksonville, FL (US); Percy F. Shadwell, Jr., Jacksonville, FL (US)

(73) Assignees: Michael F. Balanky, Jacksonville, FL (US); Ronnie L. Kirkland, Jacksonville, FL (US)

( * ) Notice: Subject to any disclaimer, the term of this patent is extended or adjusted under 35 U.S.C. 154(b) by 178 days.

(21) Appl. No.: 10/760,950

(22) Filed: Jan. 20, 2004

Related U.S. Application Data

(63) Continuation-in-part of application No. 09/866,214, filed on May 29, 2001, now abandoned.

(51) Int. Cl.[7] ..... G08B 13/08; G08B 21/00

(52) U.S. Cl. ..... 340/686.1; 340/539; 340/540; 340/545.1; 340/547; 49/25; 49/26; 49/31; 49/68; 49/69; 49/73.1

(58) Field of Search ..... 340/539, 540, 340/545.1, 547, 686.1; 49/68–73.1, 25–31

(56) References Cited

U.S. PATENT DOCUMENTS 4,929,877 A 5/1990 Clark et al.
5,247,279 A 9/1993 Sato
5,402,105 A 3/1995 Doyle et al.
5,565,843 A 10/1996 Meyvis
5,689,236 A * 11/1997 Kister ..... 340/545.1
5,712,621 A 1/1998 Andersen
5,798,681 A 8/1998 Chang
5,836,639 A 11/1998 Kleefeldt et al.
5,864,134 A 1/1999 Burgess
5,912,631 A 6/1999 Kusunoki
6,166,634 A * 12/2000 Dean ..... 340/545.1
6,310,548 B1 10/2001 Stephens, Jr. et al.
6,346,889 B1 * 2/2002 Moss ..... 340/686.1

* cited by examiner

*Primary Examiner*—Jeffery Hofsass
*Assistant Examiner*—Lam Pham
(74) *Attorney, Agent, or Firm*—Richard S. Vermut; Rogers Towers, P.A.

(57) ABSTRACT

A method, system and computer program product for adaptively tracking the position of an entry portal, such as an automatic garage door. In accordance with the present invention a transmitter assembly senses and transmits the sensed position of the door position in a periodic manner at a predetermined transmit interval. A receiver assembly including a receiver module receives the transmitted door position signals and synchronizes the activation of the receiver module with the transmit interval such that the receiver receives the door position signals transmitted at the predetermined transmit interval. A receiver output indicator is then updated in accordance with the entry portal position determined by the received door position signal.

39 Claims, 6 Drawing Sheets

METHOD AND SYSTEM FOR REMOTELY MONITORING GARAGE DOOR POSITION

CROSS REFERENCE TO RELATED APPLICATIONS

This application is a continuation in part of and claims the benefit of and priority from U.S. patent application Ser. No. 09/866,214 and filed on May 29, 2001now abandoned, the contents of which is incorporated herein in its entirety by this reference.

BACKGROUND OF THE INVENTION

1. Technical Field

The present invention relates generally to security systems and in particular to a system for detecting and tracking the position of a door. More particularly, the present invention relates to a method and system for remotely tracking the position and cyclic change of position of a door or other access portal member.

2. Description of the Related Art

Door security sensors are implemented in home or building alarm systems to detect and monitor the relative position of doors, windows or other building access structures as being either secure (e.g. closed) or unsecure (e.g. open or partially open). Such systems typically employ electronic monitoring means to sense the relative disposition of the door. On the user notification side of such systems, output devices in the form of light-emitting diodes (LEDs) and/or audio output devices are utilized to alert occupants either that the door remains secured or that the door has become unsecured (i.e. opened from a secure closed position) in accordance with the received sensor signals. The monitoring and tracking of entryway portal security status may be communicated to the local building occupants and may also be broadcast outside the building using siren-like alarms, or delivered to specified point locations using electronic signaling to notify remote persons or security agencies of a compromise in doorway security.

Conventional door monitoring systems often utilize transmitter/receiver pairs wherein the transmitter transmits a sensed door position signal to a strategically positioned receiver that in turn outputs the corresponding status or alert signal. Wireless transmitter/receiver pairs, typically using an RF communication medium, are utilized in some door monitoring applications for ease and flexibility of implementation. One such system is described in U.S. Pat. No. 5,798,681, issued to Chang, which discloses an RF-based garage door position indicator. The disclosed system of Chang employs an electronic angle sensor that is attached onto the garage door and supplies door position signals to an RF transmitter corresponding to sensed changes in orientation in the garage door from vertical to horizontal and from horizontal to vertical. The Chang system further includes an RF receiver, remotely mountable as a portable unit in a vehicle or otherwise, which is responsive to the door position signals and controls a visual/audio output accordingly.

While effective for sensing the door position and providing user alert responses, prior art door monitoring systems do not account for RF compliance with FCC continuous or periodic transmission. Furthermore, there exists a need, unsatisfied in the prior art, to implement a portable RF receiver door monitor receiver in a manner that adequately conserves battery power. The present invention addresses these and other needs unsatisfied by prior art door monitoring systems.

SUMMARY OF THE INVENTION

A method, system and computer program product for adaptively tracking the position of an entry portal, such as an automatic garage door, are disclosed herein. In accordance with the present invention a transmitter assembly senses and transmits the sensed position of the door position in a periodic manner at a predetermined transmit interval. A receiver assembly including a receiver module receives the transmitted door position signals and synchronizes the activation of the receiver module with the transmit interval such that the receiver receives the door position signals transmitted at the predetermined transmit interval. A receiver output indicator is then updated in accordance with the entry portal position determined by the received door position signal.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

The present invention is directed to an improved device, system, method and computer program product for remotely monitoring the position and movement of a door, window, or other building entrance portal that cycles from a closed position to an open position though intermediate positioning such as may be accomplished by an electronic garage door opening system. In one aspect, the present invention is intended to enable a person exiting a garage in a car to have a source of feedback as to the exact status of the garage door position.

As explained in further detail below, the system of the present invention includes a transmitter assembly comprising a sensor unit for sensing the position of the object door and delivering the sensed position to a transmitter module. The transmitter module includes circuit and program instruction means for translating, encoding, modulating and delivering the sensed door position as a transmitter signal that is broadcast via an RF antenna. A transmitter microcontroller, or suitable equivalent (e.g. a microprocessor, memory device, and suitable drivers and input/output ports), is utilized to adaptively determine the timing at which the transmitter signals will be broadcast in accordance with the presently and formerly detected door positions.

The system further includes a portable, preferably battery powered receiver assembly that generally comprises an RF antenna for receiving the broadcast transmitter signal. A corresponding receiver module includes circuit and instruction means for demodulating, decoding and detecting the incoming signal. The receiver microcontroller further includes instruction and/or circuit means for translating the detected signal and utilizing the same to drive audio and/or visual output devices to alert a remote user of the current position of the door. In a preferred embodiment, and as further explained with reference to the figures, the receiver assembly further includes circuit and program module means for controlling the activation timing of the receiver module to minimize periods of receiver module activation thus complying with air interface usage regulations and maximizing battery life.

Figure 1:
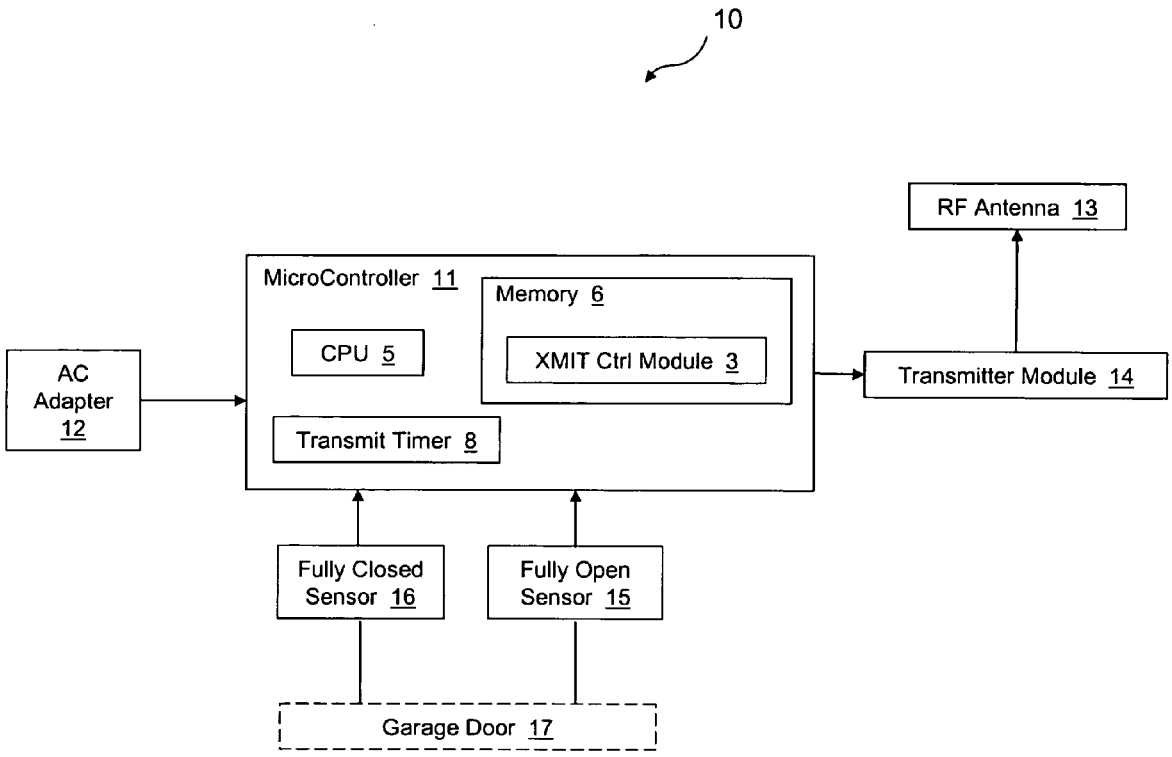
FIG. 1 is a high-level block diagram depicting a door position sensor transmitter assembly in accordance with the present invention.

With reference now to the figures, wherein like reference numerals refer to like and corresponding parts throughout, and in particular with reference to FIG. 1, there is illustrated a high-level block diagram depicting a transmitter assembly in accordance with the present invention. Specifically, a transmitter assembly 10 is shown which may be mounted in a garage and receives electrical power from an AC adapter 12 or an equivalent power source. Transmitter assembly 10 generally comprises door position sensors 15 and 16 that are communicatively coupled, such as electrically or electronically, to a transmitter microcontroller 11. In the depicted embodiment, sensor 15 is utilized to sense a state in which the door, such as an electromechanically controlled garage door 17, depicted as a dashed line box, is fully open, and sensor 16 is utilized to sense the state in which the garage door 17 is fully closed. Sensors 15 and 16 may be microswitches, magnetic reed switches, Hall Effect devices or other known sensor types mounted relative to garage door 17 in a manner such that the fully closed and fully open position of door 17 can be electronically or electromagnetically detected.

Sensors 15 and 16 are suitably coupled electronically or via wireless or air interface to transmit the sensed door position to transmitter microcontroller 11. Transmitter microcontroller 11 is typically a highly integrated chip containing all components comprising a controller including a central processing unit (CPU) 5, memory 6, input/output (I/O) ports (not depicted) and counters or timers including a transmit timer 8. As utilized herein "timer" and "counter" are used interchangeably to designate devices that may be used with clock devices to designate and mark specified time periods. Memory 6 may comprise any combination of random access memory (RAM), read-only memory (ROM) or other non-volatile data storage media in which data, and program modules and instructions such as those included in a transmit control program module 3 are stored and executed as part of the method of the present invention. In a preferred embodiment, microcontroller 11 includes hardware, software, and/or firmware means for detecting and encoding the sensed door position signal received from sensors 15 and 16 and delivering the same to a transmitter module 14 using known sensor signal processing means. Although not explicitly depicted in FIG. 1, sensors 15 and 16, and/or microcontroller 11 may include analog-to-digital converter devices for digitally encoding an originally analog sensor signal. As such, the term "sensor signal" as used in the present description may alternately refer to either the analog signal generated by a sensor device, such as a magnetic sensor, or the digitally encoded translation of the same.

Transmitter module 14 includes known signal processing circuits and modules for encoding, modulating, amplifying and otherwise preparing the sensed door position signals to be broadcast from a transmitter antenna 13, which in the depicted embodiment is an RF antenna. A variety of digital and analog encoding techniques may be employed by transmitter module 14 to encode and modulate the sensed door position signal and the modulation technique is preferably selected to ensure reliable transmission over the desired range. Although the depicted embodiment employs an integrated microcontroller, it will be appreciated by those skilled in the art that the same functionality can be achieved using application specific integrated circuits other combinations of a microprocessor and supporting controller features.

Figure 3A:
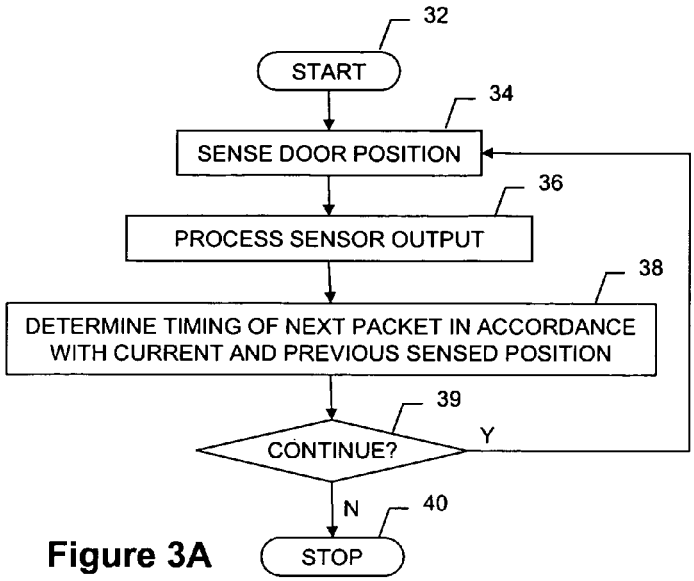
FIG. 3A is a high-level flow diagram depicting process steps for sensing and transmitting door position in accordance with the invention.
Figure 3B:
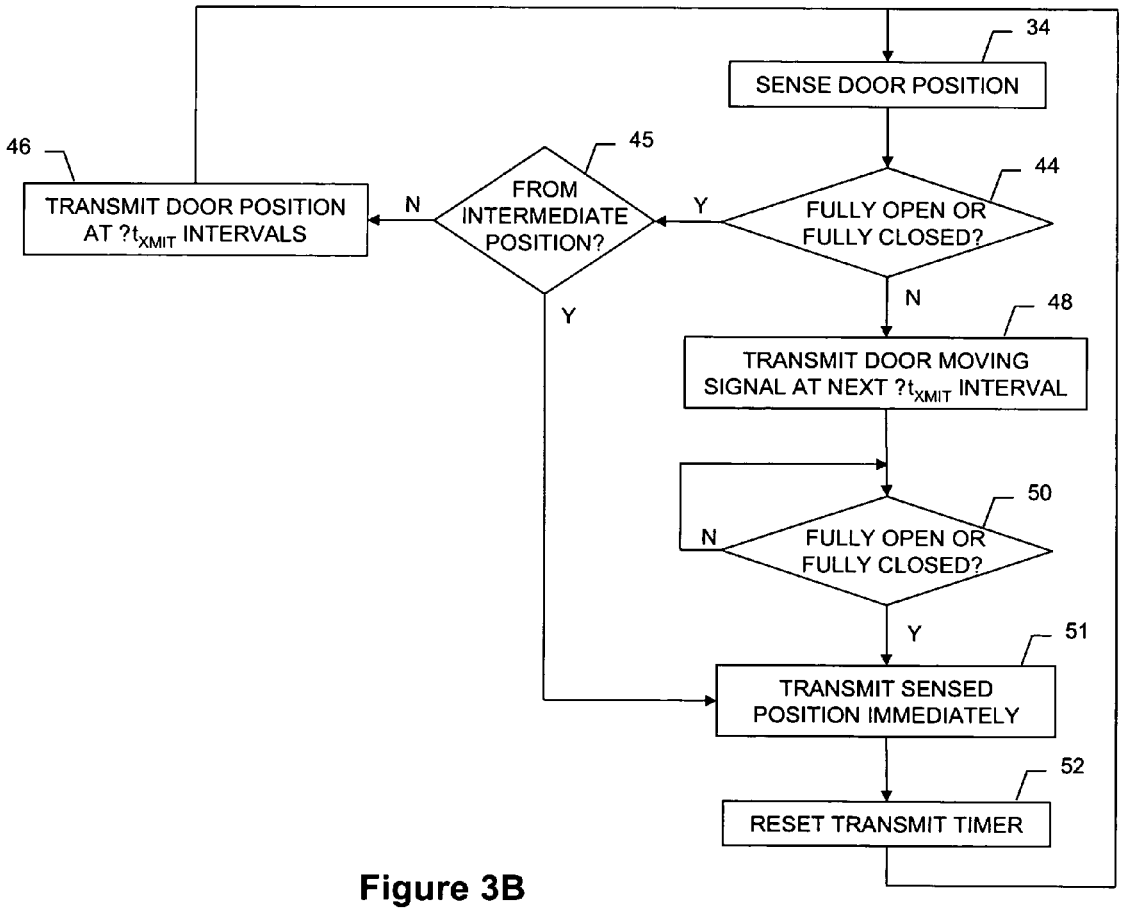
FIG. 3B is a high-level flow diagram illustrating process steps by which the transmitter assembly processes sensor feedback to determine the encoding and timing of the transmitted door position signal in accordance with current and previously sensed door positions.
Figure 6:
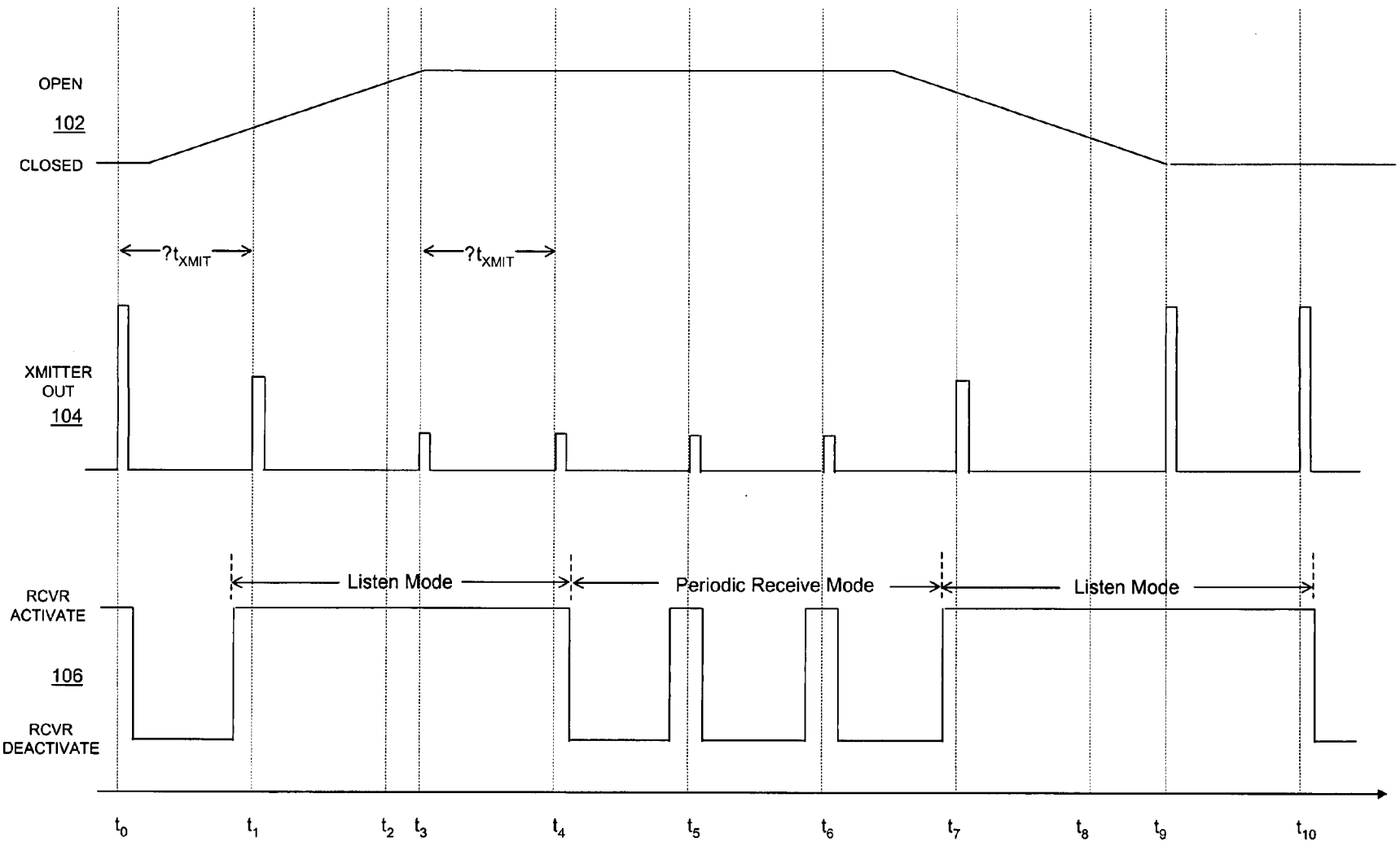
FIG. 6 is a simplified timing diagram depicted the relative timing of sensed door position, transmitter output, and receiver activation cycles in accordance with the present invention.

As depicted with reference to FIGS. 3A, 3B, and 6, the digitally encoded door position signals are sent by transmitter module 14 as groupings of one or more data packets delivered in a periodic manner. The transmission interval between successive position signal transmissions, referred to alternatively herein as the transmit period or transmit period interval, is determined in accordance with the setting of transmit timer 8. In accordance with a preferred embodiment, transmit control module 3, maintained in memory such as memory 6 within microcontroller 11, includes program instructions and/or electronic module means for setting and resetting transmit timer 8 in accordance with the outputs from sensors 15 and 16 such that the timing of any given packet is determined by the current and previously sensed door position. Those skilled in the art will appreciate that there are many possible design implementations by which timer 8 can serve its function as a timing device for marking elapsed time intervals on the order of seconds, milliseconds, microseconds, nanoseconds, as well as other time increments. Furthermore, although incorporated in transmitter microcontroller 11 in the depicted embodiment, transmit timer 8 can, in the alternative, be deployed within transmitter module 14 and as one or more individual timer devices without departing from the spirit or scope of the present invention. The periodic transmission of door position signal packets at regular predetermined intervals, and the adjustments and resetting of those intervals in accordance with the present invention are depicted and explained in further detail below with reference to FIGS. 3A, 3B, and 6.

Figure 2:
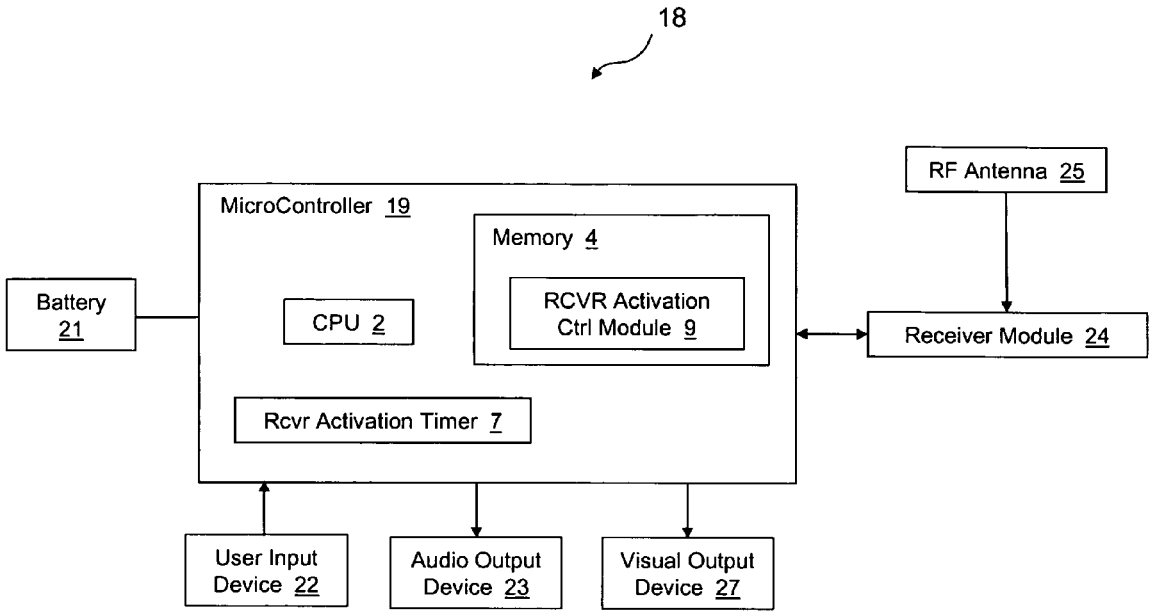
FIG. 2 is a high-level block diagram illustrating a door position receiver assembly in accordance with the present invention.

Referring to FIG. 2, there is depicted a high-level block diagram illustrating a receiver assembly 18 operably utilized in conjunction with transmitter assembly 10 as part of the overall remote door monitoring system of the present invention. Receiver assembly 18 is preferably a compact, portable unit and may be hand-carried, mounted in a vehicle, or otherwise deployed in a manner such that the receiver is transportable with respect to the stationary garage-mounted transmitter assembly 10. As shown in FIG. 2, receiver assembly 18, like transmitter assembly 10, is a microcontroller-based device and further includes a portable power source in the form of one or more batteries 21. The receiver microcontroller 19 includes as standard features a CPU 2, memory 4, I/O ports (not depicted) and timers including a receiver activation timer 7.

Inputs into receiver microcontroller 19 include a user input device 22 which may be implemented as a push-button activation or reset input device. Output devices driven by receiver microcontroller 19 include one or more audio output devices 23 and visual output devices 27. Examples of possible audio output devices 23 include audio speakers, piezo electric beepers, and the like. Examples of possible visual output devices 27 include light-emitting diode (LED) displays, liquid crystal diode (LCD) displays, and/or other known devices for providing visual door position information to a user.

Receiver assembly 18 further comprises a receiver module 24 for processing the door position signal received at an RF antenna 25 from transmitter assembly 10. More specifically, and as is well known in the art, receiver module 24 typically includes known signal processing circuits and modules for demodulating, decoding, filtering, detecting, amplifying and otherwise translating the received air-interface signals into a digital format that may be stored and processed by receiver microcontroller 19. The demodulation, decoding and other signal processing techniques employed by receiver module 24 must be matched with the corresponding design features of transmitter module 14 for mutual compatibility. Given the portable design of receiver assembly 18, the electrical power for receiver module 24 as well as for microcontroller 19 is preferably supplied by a battery source 21.

In a useful aspect of the present invention, receiver module 24 is energized/activated (i.e. constituent components and processing modules powered on and/or triggered to operate in an active receive mode) and deenergized/deactivated in a periodic manner to conserve battery power by using timing control signaling from receiver activation timer 7. Specifically, a timing signal delivered from receiver activation timer 7 is set to a specified receiver activation interval, such as may be controlled by a receiver activation control module 9. As explained in further detail below, receiver activation control module 9, maintained in memory such as memory 4 within microcontroller 19, includes program instructions or circuit module means for setting and resetting receiver activation timer 7 in accordance with the door position signals received from transmitter assembly 10, such that the activation and deactivation timing of receiver module 24 is determined by the current and previously received door position signals.

To ensure reliable reception of the periodically transmitted door position signals, and as depicted in FIG. 6, the count interval of receiver activation timer 7 is set such that an activate signal (i.e. signal activating receiver module 24) delivered from microcontroller 19 to receiver module 24 is asserted for a count interval set to temporally coincide and preferably overlap the entire transmit interval of transmitter module 14.

Responsive to the activate and deactivate time intervals marked by receiver activation timer 7, receiver microcontroller 19 delivers "activate" and "deactivate" signals enabling receiver module 24 to be energized and deenergized in a synchronized manner with the periodic door position signals transmitted from transmitter assembly 10. Specifically, and referring to FIG. 2 in conjunction with FIG. 6, receiver activation control module 9 adaptively adjusts the receiver timer count of the one or more timers comprising receiver activation timer 7 such that each receiver activation period begins before and ends after the correspondingly timed transmit period such that the receiver activation periods between the inactive intervals overlap and preferably subsume the periodic door position signal transmissions illustrated at times $t_0$, $t_1$, $t_3$, $t_4$, $t_5$, $t_6$, $t_7$, $t_9$, and $t_{10}$ in FIG. 6.

With reference to FIG. 3A, there is illustrated a high-level flow diagram depicting process steps for sensing and transmitting the position of a door, such as an automatic electromechanically controlled garage door, in accordance with the invention. The process is described herein as implemented by transmitter assembly 10 but may also be implemented by other systems and devices without departing from the spirit and scope of the present invention. The process begins as shown at steps 32 and 34 with one or more door position sensors, such as sensors 15 and 16, delivering the sensed door position to a transmitter processing unit such as microcontroller 11. Consistent with the scope of the present invention, several different combinations of door positions including various intermediate positions may be sensed and monitored by one or more such sensors. In accordance with the embodiments depicted herein, a fully closed, a fully open or intermediate door position is sensed at any given time.

Proceeding to step 36, a sensor signal indicative of the present door position is delivered to and processed by transmitter microcontroller 11. Transmit control module 3 processes the sensor signal to detect the presently sensed door position and determine the timing of the next transmitted door position signal by comparing the presently and previously sensed door position as depicted at step 38. Referring to FIG. 6, for example, if the currently sensed position is either the fully open or fully closed position and is the same as the previously sensed door position (i.e. door remains fully open or fully closed), microcontroller 11 delivers the corresponding door open or door closed signal to transmitter module 14 which transmits the signal via antenna 13 at the next transmit period interval, $\Delta t_{xmit}$, of transmit timer 8. Similarly, if the currently sensed door position has transitioned from the fully open or closed position to an intermediate position between fully open and fully closed as determined, for example by sensors 15 and 16 detecting neither a fully open nor fully closed door position, transmitter module 14 transmits a door moving or intermediate position signal at the next transmit interval $\Delta t_{xmit}$. When, however, the door position has transitioned from the intermediate position to a current fully open or fully closed position, transmitter module 14 transmits the corresponding encoded position signal immediately as determined by transmit control module 3. The process of transmitting the sensed door position and adjusting the timing of the transmissions continues until transmitter assembly 10 is deactivated as illustrated at steps 39 and 40.

With reference to FIG. 3B, there is depicted a high-level flow diagram illustrating process steps by which the transmitter assembly of the present invention processes sensor feedback to determine the encoding and timing of the transmitted door position signal in accordance with current and previously sensed door positions. Commencing with the sensing the door position as shown in step 34, and responsive to determining the sensed door position, transmitter microcontroller 11 selects a corresponding door position signal to send and the timing at which the signal will be transmitted. Many different digital encoding techniques may be employed for indicating the sensed door position and receiver assembly microcontroller 19 is pre-programmed to implement such an encoding scheme. In one embodiment, for example, a two-bit code may be utilized in which a door fully closed is encoded as "10", a door fully open is encoded as "01", a door in transition (i.e. neither fully open nor fully closed) is encoded as "00", and a system fault detected by the sensors is encoded as "11."

The transmitter-side process continues as illustrated at step 44, with a determination from the sensor output(s) of whether or not the object garage door is fully open or fully closed. As depicted at step 45, responsive to a fully closed or fully open position being detected at step 44, the timing of the next door position signal is determined in accordance with the previously detected door position signal. If, as shown at steps 45 and 51, the previously detected position was the intermediate position such that the sensor such as when the door has reached its fully open or fully closed position from such an intermediate position, the detected and digitally encoded "fully open" or "fully closed" signal is transmitted immediately. Following the immediate transmission of the fully open or fully closed signal, the transmit timer 8 is reset, as illustrated at step 52, such that the next door position signal is transmitted in accordance with the pre-determined transmit interval, $\Delta t_{xmit}$.

If, as determined at step 44, responsive to the absence of a fully open or fully closed signal indicative of a door moving or intermediate position condition, or in response to an affirmative sensor signal indicative of the same, a corresponding "door moving" or "intermediate position" signal is encoded in the transmitter output signal which is transmitted at the next regular transmit interval, $\Delta t_{xmit}$ as depicted at step 48. Next, as shown at steps 50 and 51, the sensed door position signals are processed, such as by transmit control module 3 within transmitter microcontroller 11, to determine when the door has transitioned from an intermediate position to a fully open or fully closed position, and when such condition is detected by the microcontroller, the corresponding fully open or fully closed signal is delivered immediately in an asynchronous manner. The general effect of the transmitter side encoding and transmission timing as depicted in FIGS. 3A and 3B, may be viewed with reference to FIG. 6.

Specifically, and referring to FIG. 6, a transmitter output signal 104 includes three different pulse levels including a highest pulse representative of the digitally encoded fully closed signal, an intermediate pulse level representative of the digitally encoded door moving signal, and the lowest pulse level representative of the digitally encoded fully open signal. In the depicted embodiment, the transmitter output signals are transmitted in a generally synchronous manner that is interrupted when the sensed signal shifts from the intermediate position to the fully open or fully closed position as occurs at time $t_3$ when the sensor output indicates a transition from an intermediate position to the fully open position and at time $t_9$ when the sensor output indicates a transition from an intermediate position to the fully closed position as indicated by door position signal line 102.

Figure 4:
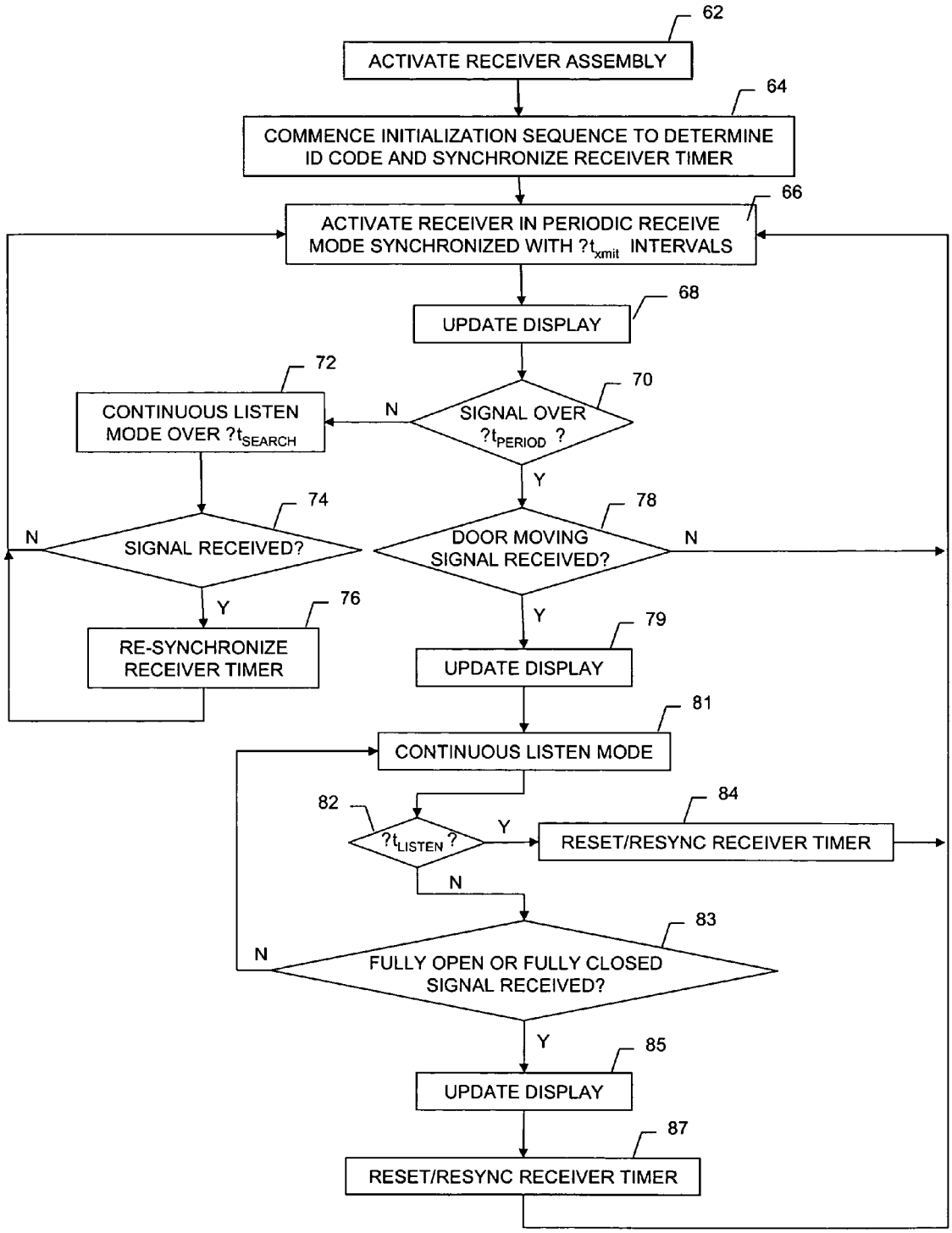
FIG. 4 is a high-level flow diagram depicting process steps performed by a receiver assembly in tracking door position and movement in accordance with one embodiment of the present invention.

FIG. 4 is a high-level flow diagram depicting process steps performed by a receiver assembly in tracking door position and movement in accordance with one embodiment of the present invention. Several receiver "activation modes" are included in the following description with the term "activation mode" signifying the fraction of time over any given time interval that one or more components of receiver assembly 18, and particularly, receiver module 24 is activated to receive incoming door position signals. For example, in a periodic activation mode, the receiver is activated in a periodic manner in which over a given time interval (typically coinciding with the transmit interval) the receiver is activated (indicated by a high signal level in FIG. 6), for a relatively short time increment. In a continuous activation mode, the receiver is activated continuously for a specified period. The process begins as shown at steps 62 and 64 with an initialization sequence executed upon initial activation or resetting of receiver microcontroller 19 and/or receiver module 24. Next, as depicted at step 66 receiver module 24 is activated and deactivated in a periodic activation mode as synchronized with $\Delta t_{xmit}$ as depicted by receiver activation signal 106 (FIG. 6) such that the activation periods coincide with and preferably overlap on each side the corresponding transmitter output signals designated as square wave pulses on transmitter output 104. In a preferred embodiment, the transmit interval and corresponding periodic receive activation intervals are approximately 10 seconds with the receiver activated for approximately one second per interval. As illustrated at step 68, the display or audio output is updated as per the received signal, indicating either a door fully open, a door fully closed or a door intermediate in the intermediate or moving position.

Proceeding to step 70, a determination is made of whether or not a properly authenticated transmitter signal has been received over a specified period, $\Delta t_{period}$, such as may be one or more hours and preferably six hours. If not, and as illustrated at step 72, receiver activation control module 9 directs receiver module 24 to begin a continuous listen activation mode for a signal search period $\Delta t_{search}$ which in a preferred embodiment is a period greater than or equal to the transmit period such that, for a preferable transmit period of approximately 10 seconds, the signal search period is eleven seconds. As depicted at steps 74, 76 and 66, responsive to a signal being received during the search period the receiver activation timer 7 is resynchronized, such as by the process depicted in FIG. 5 and receiver microcontroller 19 continues in its periodic receiver activation. If a properly authenticated transmitter signal is not received during $\Delta t_{search}$, receiver microcontroller 19 continues without resynchronization in the present periodic receiver activation mode as shown at steps 74 and 66.

Returning to step 70, as long as transmitter signals are received with relative consistency (i.e. not absent over $\Delta t_{period}$), receiver microcontroller 19 continues updating the display/audio outputs (steps 66 and 68) according to the door position indicated by the incoming signals. When, as shown at steps 78 and 79, a door moving signal is received (as shown in FIG. 6 at times $t_1$ and $t_7$), the display/audio outputs are updated accordingly (step 79) and receiver microcontroller 19 delivers a signal to receiver module 24 instructing the module to activate for continuous listen period as shown at step 81. FIG. 6 graphically depicts as listen modes as initiated by the intermediate level door moving signal transmitted and received at approximately times $t_1$ and $t_7$.

Figure 5:
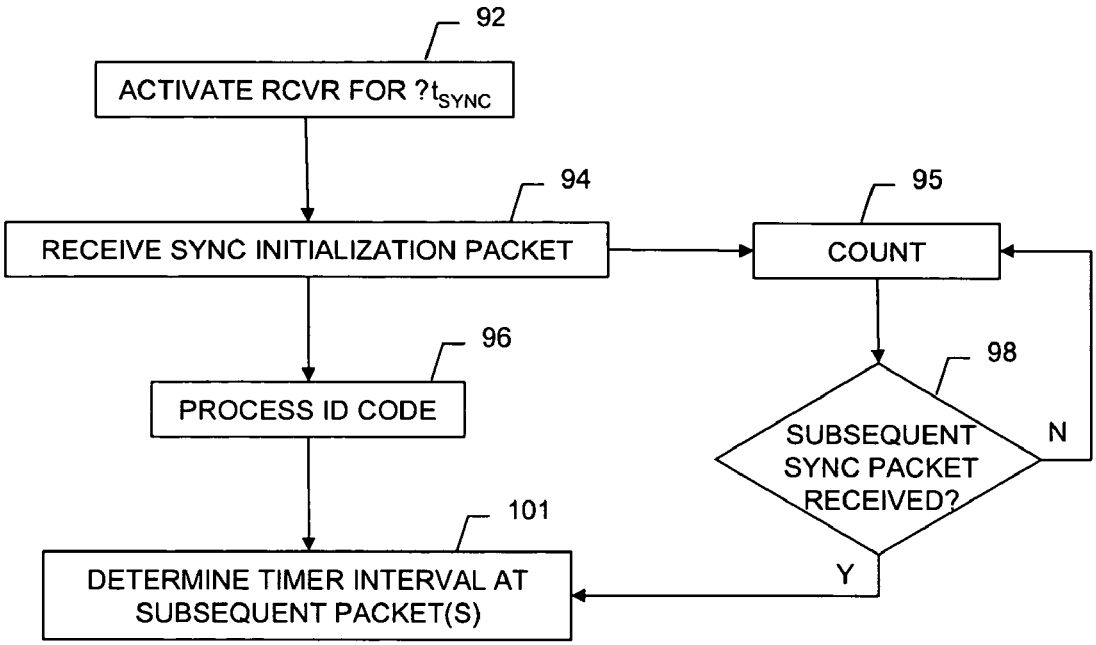
FIG. 5 is a high-level flow diagram illustrating process steps performed during receiver initialization or resetting and synchronization in accordance with the present invention.

Proceeding to steps 82, 83, and 84, receiver module 24 remains in continuous receive mode for a given $\Delta t_{listen}$ period, which is preferably a multiple of $\Delta t_{xmit}$, and upon expiration of $\Delta t_{listen}$ with neither a fully open nor fully closed signal received, receiver microcontroller 19 such as via instructions from receiver activation control module 9, directs receiver module 24 to re-commence the periodic receiver activation mode with receiver activation timer 7 preferably reset and resynchronized in accordance with the procedure depicted in FIG. 5. If, as illustrated at steps 83, 85, and 87, a fully open or fully closed signal is received during the continuous listen mode, the display/audio outputs are updated in accordance with the immediately transmitted signal from transmitter assembly 10 and receiver activation timer 7 is reset and resynchronized with the re-established transmission interval $\Delta t_{xmit}$ and returns to the periodic receiver activation mode of operation.

FIG. 5 is a high-level flow diagram illustrating process steps performed during receiver initialization or resetting and synchronization as performed during steps 64, 84 and 87 in accordance with the present invention. The process begins as shown at step 92 with receiver activation timer 7 activated under the control of microcontroller 19 for a synchronization period, $\Delta t_{sync}$. The duration of $\Delta t_{sync}$ is preferably incrementally greater than the predetermined $\Delta t_{xmit}$ period. Next, when an initial transmitter signal is received, receiver microcontroller 19 processes an identification code contained within the signal for authentication purposes (step 96) and a count is begun, using receiver activation timer 7 or other timer (step 95) to determine the transmit interval duration $\Delta t_{xmit}$ at which the next signal is received (step 98). Upon receiving the next signal, the transmit interval duration is used to determine a corresponding and temporally in-phase receiver activation interval as illustrated at step 101.

The foregoing method and system enables utilizes a cooperative transmitter receiver protocol enabling remote tracking of the relative position of a garage door or other entry portal while conserving the limited energy source of a portable receiver assembly. Furthermore, the periodic transmission feature of remote door tracking system of the present invention enables compliance with air interface traffic regulations while ensuring reliable feedback to a mobile receiver of the position of a door. It should be noted that while the foregoing embodiments have been described with respect to detecting and tracking the position of a garage door, the methods and systems explained herein may be applied to other types of entry portal such as vertically hinged doors, horizontal sliding doors, windows, and the like, without departing from the spirit or scope of the present invention.

Preferred implementations of the invention include implementations as a computer system programmed to execute the method or methods described herein, and as a program product. According to the computer system implementation, sets of instructions for executing the method and system of the present invention are resident in a storage device such as the ROM or RAM of one or more computer systems. Until required by the computer system, the set of instructions may be stored as a computer-program product in another computer data storage device such as a disk drive which may include a removable storage media such as an optical disk or floppy disk for eventual utilization in the disk drive.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. A method for adaptively tracking the position of an entry portal, wherein the sensed position of the entry portal position is transmitted at a predetermined transmit interval, said method comprising:

synchronizing the activation of a receiver with said transmit interval such that the receiver receives entry portal position signals transmitted at the predetermined transmit interval; and updating a receiver output indicator in accordance with the entry portal position determined by the received entry portal position signal.

2. The method of claim 1, further comprising determining a receiver activation mode in accordance with the received entry portal position signal as sensed and transmitted by a transmitter assembly.

3. The method of claim 2, wherein the transmitter assembly senses and transmits fully open or fully closed position signals at a given transmit interval, said method further comprising, responsive to receiving a fully open or fully closed position signal at the transmit interval immediately preceding the given transmit interval, operating said receiver in a periodic receive mode wherein receiver activation periods are synchronized with the transmit interval.

4. The method of claim 3, further comprising updating the output of a receiver output device in accordance with the received fully open or fully closed signal.

5. The method of claim 2, wherein the transmitter assembly senses and transmits an intermediate position signal at a given transmit interval, said method further comprising, responsive to receiving the intermediate position signal, operating said receiver in a continuous receive mode.

6. The method of claim 5, wherein the continuous receive mode is maintained for a maximum duration that is an approximate multiple of the transmit interval.

7. The method of claim 6, wherein the continuous receive mode is maintained for a maximum duration that is four times the duration of the transmit interval.

8. The method of claim 5, further comprising updating the output of a receiver output device in accordance with the received intermediate position signal.

9. The method of claim 5, wherein the transmitter assembly transmits a fully open or fully closed position signal asynchronously during the continuous receive mode when the transmitter assembly senses a fully open or fully closed position following sensing an intermediate position, said method further comprising, responsive to receiving the fully open or fully closed position signal during the continuous receive mode, re-synchronizing the activation of the receiver with the transmit interval.

10. The method of claim 1, wherein said synchronizing comprises:

receiving a first transmitter assembly signal;

initiating a counter to determine the transmit interval in accordance with the arrival of a subsequent transmitter assembly signal; and determining a receiver activation interval the temporally coincides with the transmit interval, wherein during the receiver activation interval, the receiver is activated for a subpart of the receiver activation interval.

11. The method of claim 10, wherein the receiver activation interval is approximately ten seconds and the receiver is activated during each receiver activation interval for approximately one second such that the activation of the receiver during each activation interval temporally coincides with the transmitter signal delivered during each transmit interval.

12. The method of claim 1, further comprising responsive to the receiver receiving no transmitted position signal for specified period, commencing a continuous listen activation mode for a duration that is greater than the transmit interval.

13. The method of claim 12, further comprising, responsive to receiving a transmitted position signal during said continuous listen activation mode, re-synchronizing the activation of the receiver with the transmit interval.

14. A system for adaptively tracking the position of an entry portal, wherein the sensed position of the entry portal position is transmitted at a predetermined transmit interval, said system comprising:

electronic processing means for synchronizing the activation of a receiver with said transmit interval such that the receiver receives entry portal position signals transmitted at the predetermined transmit interval; and electronic output means for updating a receiver output indicator in accordance with the entry portal position determined by the received entry portal position signal.

15. The system of claim 14, further comprising means for determining a receiver activation mode in accordance with the received entry portal position signal as sensed and transmitted by a transmitter assembly.

16. The system of claim 15, wherein the transmitter assembly senses and transmits fully open or fully closed position signals at a given transmit interval, said system further comprising, means responsive to receiving a fully open or fully closed position signal at the transmit interval immediately preceding the given transmit interval, for operating said receiver in a periodic receive mode wherein receiver activation periods are synchronized with the transmit interval.

17. The system of claim 16, further comprising means for updating the output of a receiver output device in accordance with the received fully open or fully closed signal.

18. The system of claim 15, wherein the transmitter assembly senses and transmits an intermediate position signal at a given transmit interval, said system further comprising, means responsive to receiving the intermediate position signal, for operating said receiver in a continuous receive mode.

19. The system of claim 18, wherein the continuous receive mode is maintained for a maximum duration that is an approximate multiple of the transmit interval.

20. The system of claim 19, wherein the continuous receive mode is maintained for a maximum duration that is four times the duration of the transmit interval.

21. The system of claim 18, further comprising means for updating the output of a receiver output device in accordance with the received intermediate position signal.

22. The system of claim 18, wherein the transmitter assembly transmits a fully open or fully closed position signal asynchronously during the continuous receive mode when the transmitter assembly senses a fully open or fully closed position following sensing an intermediate position, said system further comprising, means responsive to receiving the fully open or fully closed position signal during the continuous receive mode, for re-synchronizing the activation of the receiver with the transmit interval.

23. The system of claim 14, wherein said electronic synchronizing means comprises:

a receiver module for receiving a first transmitter assembly signal;

means for initiating a counter to determine the transmit interval in accordance with the arrival of a subsequent transmitter assembly signal; and means for determining a receiver activation interval the temporally coincides with the transmit interval, wherein during the receiver activation interval, the receiver is activated for a subpart of the receiver activation interval.

24. The system of claim 23, wherein the receiver activation interval is approximately ten seconds and the receiver is activated during each receiver activation interval for approximately one second such that the activation of the receiver during each activation interval temporally coincides with the transmitter signal delivered during each transmit interval.

25. The system of claim 14, further comprising means responsive to the receiver receiving no transmitted position signal for specified period, for commencing a continuous listen activation mode for a duration that is greater than the transmit interval.

26. The system of claim 25, further comprising, means responsive to receiving a transmitted position signal during said continuous listen activation mode, for re-synchronizing the activation of the receiver with the transmit interval.

27. A computer program product residing on a computer-readable medium for adaptively tracking the position of an entry portal, wherein the sensed position of the entry portal position is transmitted at a predetermined transmit interval, said computer program product having computer-executable instructions for performing a method comprising:

synchronizing the activation of a receiver with said transmit interval such that the receiver receives entry portal position signals transmitted at the predetermined transmit interval; and updating a receiver output indicator in accordance with the entry portal position determined by the received entry portal position signal.

28. The program product of claim 27, further comprising determining a receiver activation mode in accordance with the received entry portal position signal as sensed and transmitted by a transmitter assembly.

29. The program product of claim 28, wherein the transmitter assembly senses and transmits fully open or fully closed position signals at a given transmit interval, said method further comprising, responsive to receiving a fully open or fully closed position signal at the transmit interval immediately preceding the given transmit interval, operating said receiver in a periodic receive mode wherein receiver activation periods are synchronized with the transmit interval.

30. The program product of claim 29, wherein said method further comprises updating the output of a receiver output device in accordance with the received fully open or fully closed signal.

31. The program product of claim 28, wherein the transmitter assembly senses and transmits an intermediate position signal at a given transmit interval, said method further comprising, responsive to receiving the intermediate position signal, operating said receiver in a continuous receive mode.

32. The program product of claim 31, wherein the continuous receive mode is maintained for a maximum duration that is an approximate multiple of the transmit interval.

33. The program product of claim 32, wherein the continuous receive mode is maintained for a maximum duration that is four times the duration of the transmit interval.

34. The program product of claim 31, wherein said method further comprises updating the output of a receiver output device in accordance with the received intermediate position signal.

35. The program product of claim 31, wherein the transmitter assembly transmits a fully open or fully closed position signal asynchronously during the continuous receive mode when the transmitter assembly senses a fully open or fully closed position following sensing an intermediate position, said method further comprising, responsive to receiving the fully open or fully closed position signal during the continuous receive mode, re-synchronizing the activation of the receiver with the transmit interval.

36. The program product of claim 27, wherein said synchronizing comprises:

receiving a first transmitter assembly signal;

initiating a counter to determine the transmit interval in accordance with the arrival of a subsequent transmitter assembly signal; and determining a receiver activation interval the temporally coincides with the transmit interval, wherein during the receiver activation interval, the receiver is activated for a subpart of the receiver activation interval.

37. The program product of claim 36, wherein the receiver activation interval is approximately ten seconds and the receiver is activated during each receiver activation interval for approximately one second such that the activation of the receiver during each activation interval temporally coincides with the transmitter signal delivered during each transmit interval.

38. The program product of claim 27, further comprising responsive to the receiver receiving no transmitted position signal for specified period, commencing a continuous listen activation mode for a duration that is greater than the transmit interval.

39. The program product of claim 38, further comprising, responsive to receiving a transmitted position signal during said continuous listen activation mode, re-synchronizing the activation of the receiver with the transmit interval.

* * * * *